United States Patent [19]

Young et al.

[11] 4,410,865

[45] Oct. 18, 1983

[54] SPHERICAL CAVITY MICROWAVE FILTER

[75] Inventors: Frederick A. Young; Edward L. Griffin, both of Huntington Beach, Calif.

[73] Assignee: Hughes Aircraft Company, El Segundo, Calif.

[21] Appl. No.: 351,811

[22] Filed: Feb. 24, 1982

[51] Int. Cl.[3] ..... H01P 1/208; H01P 7/06

[52] U.S. Cl. ..... 333/208; 333/209; 333/230

[58] Field of Search ..... 333/202, 208, 209, 212, 333/227, 228, 230, 232, 235, 248, 21 A, 21 R

[56] References Cited

U.S. PATENT DOCUMENTS 2,890,421 6/1959 Currie ..... 333/208

3,697,898 10/1972 Blachier et al. ..... 333/209 X 4,060,779 11/1977 Atia et al. ..... 333/21 A X 4,241,323 12/1980 Griffin et al. ..... 333/212 X

*Primary Examiner*—Marvin L. Nussbaum

*Attorney, Agent, or Firm*—William J. Benman, Jr.; William J. Bethurum; A. W. Karambelas

[57] ABSTRACT

A tri-mode spherical cavity microwave filter comprising two tandemly disposed generally spherical bodies each of which defines a spherical cavity which supports three identical, mutually orthogonal modes of electromagnetic energy, a cavity coupling aperture connecting the cavities, a plurality of cavity tuning holes, and a plurality of coupling tuning holes. One of the spherical cavities has an input aperture, and another has an output aperture. The cavity tuning holes and coupling tuning holes are adapted to receive cavity tuners and coupling tuners, respectively.

2 Claims, 7 Drawing Figures

SPHERICAL CAVITY MICROWAVE FILTER

TECHNICAL FIELD

This invention relates to microwave filters and, more particularly, to spherical cavity microwave filters.

BACKGROUND OF THE INVENTION

1. Field of the Invention

To obtain desired responses from microwave systems, microwave filters are generally required. One such response from a microwave system is its capability to transmit only a selected, and often narrow, band of frequencies in the microwave region of electromagnetic energy. This response is generally called a bandpass response. And, the microwave filter used to obtain such a response is generally called a bandpass filter, which is the subject of the present invention.

2. Description of the Prior Art

Microwave bandpass filters are generally constructed from physical cavities of rectangular, cylindrical, or spherical shapes. Filters consisting of a single cavity, or a plurality of linked rectangular or cylindrical cavities are common in the prior art. They are, however, deficient in several aspects.

In single cavity filters, an example of which is shown and described in T. Ishii, "Microwave Engineering," The Ronald Press Co., New York, 1966, pages 82–95, the bandpass responses produced are generally not adequate because the electromagnetic energy outside the desired band is not sufficiently attenuated to provide responses that are generally preferred, such as Tchebychev and elliptic functions.

One approach to provide a microwave filter having the proper bandpass characteristics is to link together cavities. In this instance, the electromagnetic energy, traveling through a chain of identical cavities, is sequentially affected by each cavity's bandpass characteristics. This cumulative effect is generally sufficient to restrict the electromagnetic energy to the preferred responses. This approach, however, causes microwave filters to be bulky and difficult to be adapted for use in size or weight limited environments such as a spacecraft. To alleviate such deficiency, multiple mode filters such as the dual mode cylindrical or rectangular filter disclosed in Blachier et al., U.S. Pat. No. 3,697,898, have been provided.

In dual mode filters, a cavity is provided wherein that cavity is allowed to support two modes of a filter's resonant frequency, a mode being the electric field shape or configuration of that resonant frequency in the cavity. In general, to produce the desired response from a filter, a cavity is configured to allow the passage of only a particular mode of the resonant frequency. The electromagnetic energy, restricted to this mode, emerges from the filter with the desired response. In the instance of the dual mode filter, rather than have only one mode oscillating in a cavity, that one mode is tuned or perturbed to create a second mode. However, the second mode has one difference, that is, the direction of its electric field is orthogonal to the electric field of the first mode. This phenomenon, generally referred to as dual mode, allows the electromagnetic energy to be affected by the cavity's bandpass characteristics twice in one cavity rather than only once. Thus, with two modes rather than one oscillating at the same resonant frequency in a cavity, the number of cavities necessary to produce the desired responses is correspondingly reduced by one-half. The perturbation of the electric field of one mode to produce an orthogonal mode is generally called coupling, which invariably is caused by structural discontinuities in the cavity such as screws positioned on its wall that perturb the electric field of the first mode.

To produce the response characteristics of a multiple cavity filter, these dual mode cavities also may be linked together. The linking mechanism in this instance is generally provided by an aperture between any two cavities. This phenomenon, also generally called coupling, allows the transfer of energy from one mode in the first cavity to another mode in the second in order to have the energy further filtered. In particular, coupling of one mode to a non-adjacent mode must be used. Since the modes are sequentially coupled in a multiple cavity filter, a non-adjacent mode refers to any mode that is not sequentially adjacent to the mode of interest. Filters employing this technique, generally called bridge coupling, are disclosed in Blachier et al., supra, and Atia et al., U.S. Pat. No. 4,060,779.

Since the definition of one mode resonating in a cavity is generally referred to as an electrical section, a dual mode cavity is defined as supporting two sections in each cavity. Accordingly, a three cavity dual mode filter would produce the response characteristics of a six section single mode filter.

Another approach to provide a microwave filter having the proper bandpass characteristics is to maximize the number of modes in a single cavity. One such example is the tri-mode single sphere filter disclosed in Currie, U.S. Pat. No. 2,890,421. In this filter, three non-identical orthogonal modes of the electromagnetic energy reside in a sphere. These modes are coupled together by screws to provide the characteristics of a three-section filter. An alternative embodiment, due to the use of more coupling screws, acts as a five-section filter. This filter, however, lacks the capability to provide the characteristics of a six-section or more filter and, more importantly, the characteristics of a filter having an elliptic function response. This incapacity is due to the presence of uncontrollable and undesirable modes when the original tri-modes are coupled to act as a filter having greater than five sections.

SUMMARY OF THE INVENTION

In view of the deficiencies in the prior art, it is a general purpose of the present invention to provide a microwave filter that is small in size and light in weight. Accordingly, the present invention provides a tri-mode, spherical cavity microwave filter for use in a microwave system having electromagnetic energy propagating therethrough. The microwave filter comprises two tandemly disposed spherical bodies each of which defines a spherical cavity, a cavity coupling aperture connecting the cavities, a plurality of cavity tuning holes, and a plurality of coupling tuning holes.

More particularly, the first of the spherical cavities has an input aperture adapted to receive the electromagnetic energy propagating from an input waveguide, and the other spherical cavity has a similar output aperture adapted to transmit the electromagnetic energy to an output waveguide. Each spherical cavity supports three identical, mutually orthogonal modes of the electromagnetic energy, all of which oscillate at the filter resonant frequency. The identical modes are three mutually orthogonal orientations of one mode. The cavity coupling aperture is adapted to transfer the electromagnetic energy from one cavity to the other. Further, each of the cavity tuning holes, which are positioned on each spherical cavity, is adapted to receive a cavity tuner which is used for independent tuning of one of the modes to the resonant frequency. Similarly, each of the coupling tuning holes, which are also positioned on each spherical cavity, is adapted to receive a coupling tuner which is used for transferring the energy of one mode to another mode within each spherical cavity.

One advantage of the present invention is the use of only two cavities to produce the bandpass characteristics of a six-section microwave filter. This filter is smaller and lighter than a corresponding dual mode, three cavity, six-section filter, resulting in a filter that can be easily adapted for use in a spacecraft.

Another advantage of the present invention is that the spherical cavity, among all cavity geometries, produces the highest Q factor or the lowest losses. This results in a better performing filter than filters having rectangular or cylindrical cavities.

A further advantage of the present invention is that the twin spherical cavity filter employs controllable, identical orthogonal modes of the electromagnetic energy, and bridge coupling technique.

Other purposes, features, and advantages of the present invention will appear from the following detailed description of the preferred embodiment thereof, taken together with the accompanying drawings.

DETAILED DESCRIPTION OF THE PREFERRED EMBODIMENT

Figure 2:
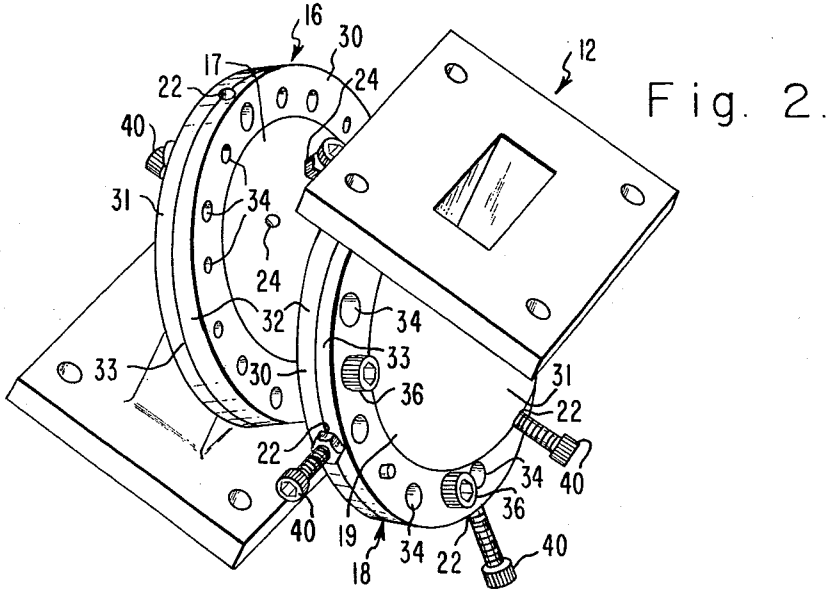
FIG. 2 is a perspective view of a novel twin sphere, tri-mode $TM_{011}$ microwave filter of the present invention.
Figure 1:
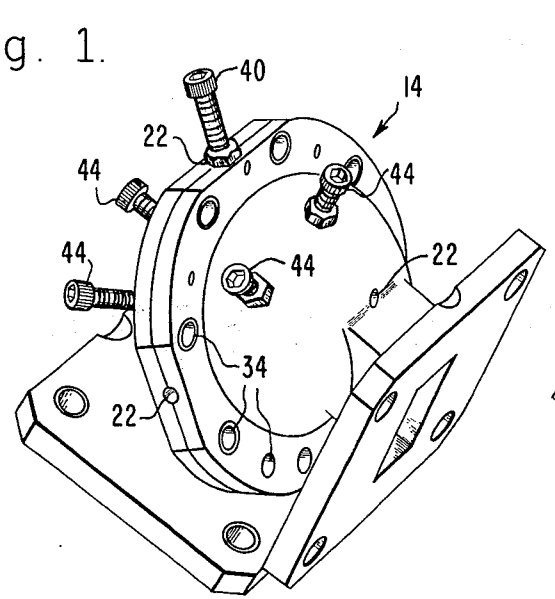
FIG. 1 is a perspective view of a single sphere microwave filter of the prior art.

Referring to FIG. 2, the twin sphere, tri-mode, $TM_{011}$ microwave filter of the present invention, generally designated 12, is adapted for use in a microwave system, now shown, which has electromagnetic energy propagating therethrough. Shown in FIG. 1 is a prior art single sphere microwave filter 14.

Figure 4:
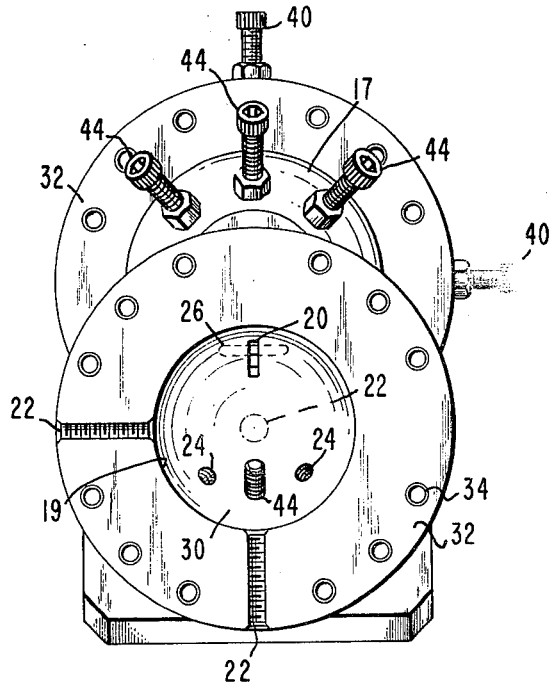
FIG. 4 is a cross-sectional view of the microwave filter of FIG. 2, with hemisphere 31 of cavity 19 removed to reveal the interior of cavity 19.
Figure 5:
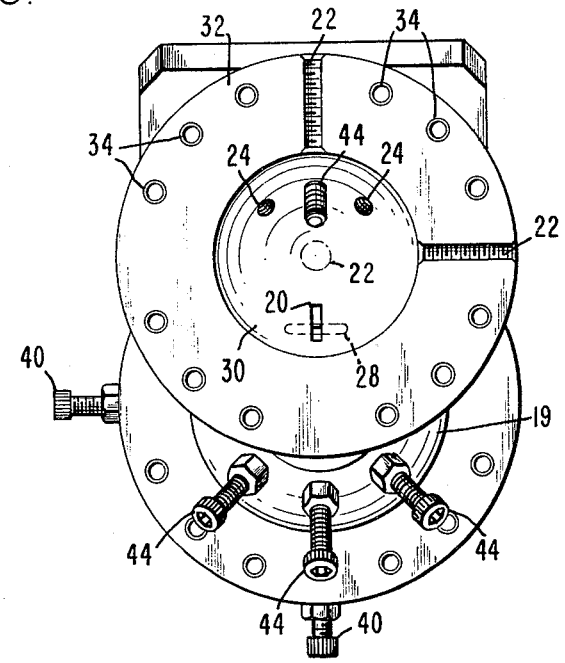
FIG. 5 is a cross-sectional view of the microwave filter of FIG. 2, with hemisphere 31 of cavity 17 removed to reveal the interior of cavity 17.

Microwave filter 12 comprises two generally spherical bodies 16, 18, defining two respective spherical cavities 17, 19, a cavity coupling aperture 20 connecting cavities 17 and 19, which is best shown in FIGS. 4 and 5, a plurality of cavity tuning threaded holes 22, and a plurality of coupling tuning threaded holes 24. Aperture 20 is a narrow rectangular slot, generally called an iris.

More particularly, spherical cavity 17 has an input aperture 26, as best shown by dotted lines in FIG. 4, which is adapted to transfer or couple the electromagnetic energy from an input waveguide, not shown, into spherical cavity 17. Similarly, spherical cavity 19 has an output aperture 28, as best shown by dotted lines in FIG. 5, which is adapted to couple the electromagnetic energy from spherical cavity 19 into an output waveguide, also not shown. Apertures 26, 28 are also commonly referred to as irises. Further, each of spherical cavities 17, 19 supports three identical, mutually orthogonal $TM_{011}$ modes of the electromagnetic energy, as best shown schematically in FIG. 3. The identical modes are three mutually orthogonal orientations of the $TM_{011}$ mode. Since spherical cavities 17 and 19 are nearly identical structurally and each provides the same elements, only spherical cavity 19 will now be described.

Spherical cavity 19 is constructed from two hemispheres 30, 31, each of which includes an outwardly extending flange 32, 33, respectively. Each of flanges 32, 33 includes a plurality of threaded mounting holes 34. Mounting screws 36, threading through their respective holes 34, force hemispheres 30, 31 into spherical body 18 which defines spherical cavity 19. The preferred embodiment includes twelve such mounting holes 34 and mounting screws 36. Hemispheres 30, 31 are manufactured from metallic materials with a coating of very high electrical conductivity material such as aluminum, silver, gold, etc.

In the preferred embodiment, spherical cavity 19 includes three mutually orthogonally positioned cavity tuning threaded holes 22, each of which is adapted to receive a cavity tuning screw 40. As best shown in FIGS. 4 and 5, each of the cavity tuning screws 40 is positioned along a radius that coincides with one orientation of the electric field vectors that represent the $TM_{011}$ modes in order to tune each mode to the filter resonant frequency.

The position of one cavity tuning threaded hole 22, which is on removed hemisphere 31, is shown by the dotted lines. Further, spherical cavity 19 includes three coupling tuning threaded holes 24, each of which is similarly adapted to receive a coupling tuning screw 44, also best shown in FIGS. 4 and 5. Coupling tuning screws 44 are used for coupling or transferring of energy from one mode into a second orthogonal mode. Screws 44 are positioned along radii not coincident with the mutually orthogonal $TM_{011}$ modes. Preferably, each coupling screw 44 is positioned at 45° angle to both of the electric field vectors of the modes that it couples. In addition to coupling tuning screws 44 which are used to couple or transfer the electromagnetic energy between modes all of which reside within the same cavity, apertures 20, 26 and 28 are used to transfer the energy between a mode residing in a cavity with another which is outside it.

Figure 3:
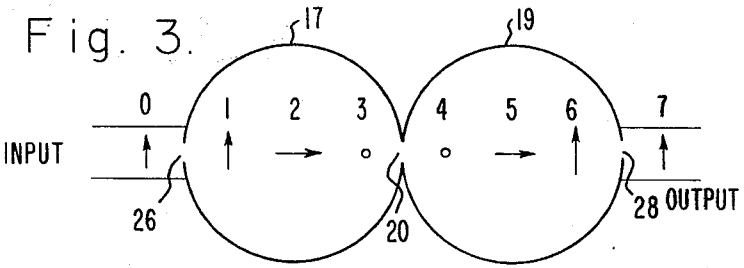
FIG. 3 is a diagrammatical view of the orientation of the identical, mutually orthogonal $TM_{011}$ modes propagating through the microwave filter of FIG. 2.

In operation, a $TM_{011}$ mode having an electric field, given an orientation shown by the vector 0 in FIG. 3, is provided at input iris 26 of the spherical cavity 17. Iris 26, which has an orientation orthogonal to vector 0, permits the coupling or transfer of mode 0 from the input waveguide into spherical cavity 17 as represented by vector 1. The capability to transfer an orthogonal electric field is an inherent characteristic of irises. A cavity tuning screw 40, having the same orientation as vector 1, is then used to tune mode 1 to the filter resonant frequency. Next, a coupling tuning screw 44 is used to perturb the electric field of mode 1 in order to create an orthogonal mode, the electric field of which is presented by vector 2. This action transfers the energy of mode 1 to mode 2. Mode 2 is then turned to the resonant frequency by another cavity tuning screw 40 that has the same orientation as vector 2. Similarly, another coupling tuning screw 44 is used to perturb mode 2 to create a third orthogonal mode that is mutually orthogonal to both modes 1 and 2 as represented by vector 3. Mode 3 is then tuned to the resonant frequency by a third cavity tuning screw 40. Positioned orthogonal to mode 3, iris 20 allows the transfer of mode 3 into spherical cavity 19 as represented by vector 4. The steps of creating additional modes in spherical cavity 17 are similarly repeated in spherical cavity 19 to create modes 5 and 6. Lastly, mode 6 is transferred to an output waveguide as vector 7 by iris 28 that is orthogonal to vectors 6 and 7. As best shown in FIGS. 3, 4 and 5, irises 26, 28 are oriented in the same direction, with iris 20 being oriented orthogonal to both. This sequential coupling of one mode to create another is generally referred to as mainline coupling. Thus, each of spherical cavities 17, 19 supports three identical, mutually orthogonal $TM_{011}$ modes, thereby defining three electrical sections.

Figure 6:
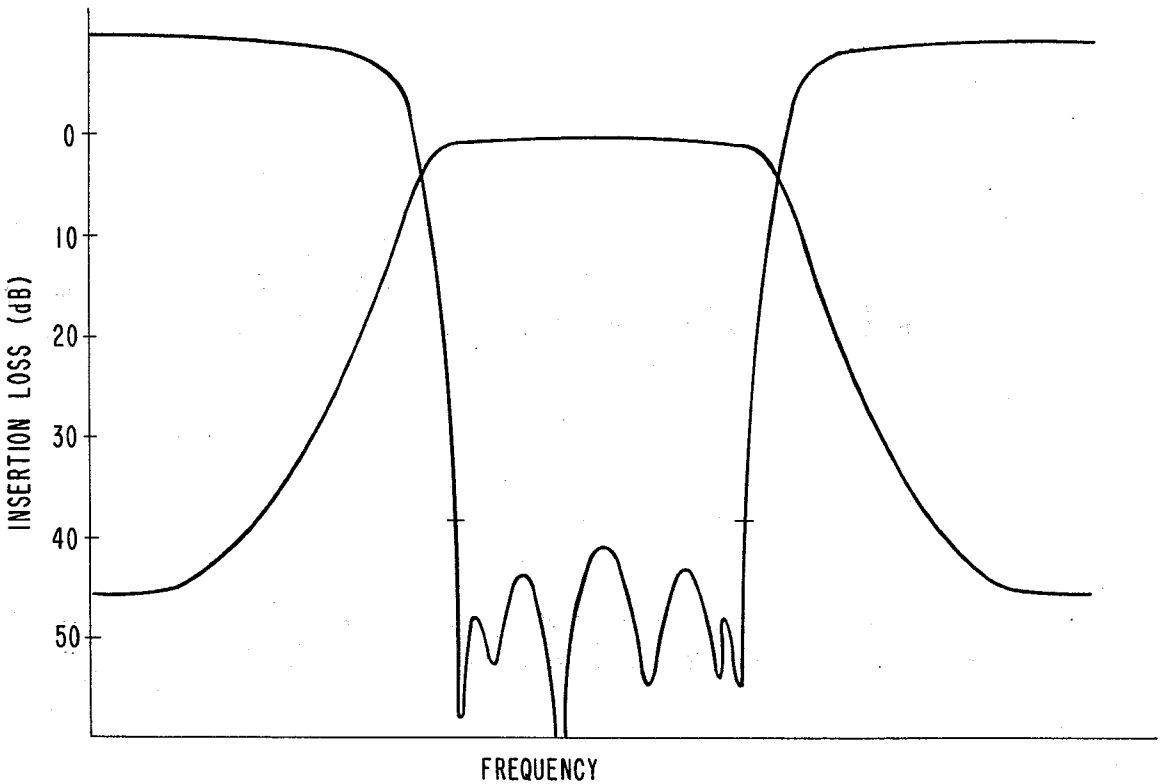
FIG. 6 is a graph showing the Tchebychev function response of the microwave filter of FIG. 2.
Figure 7:
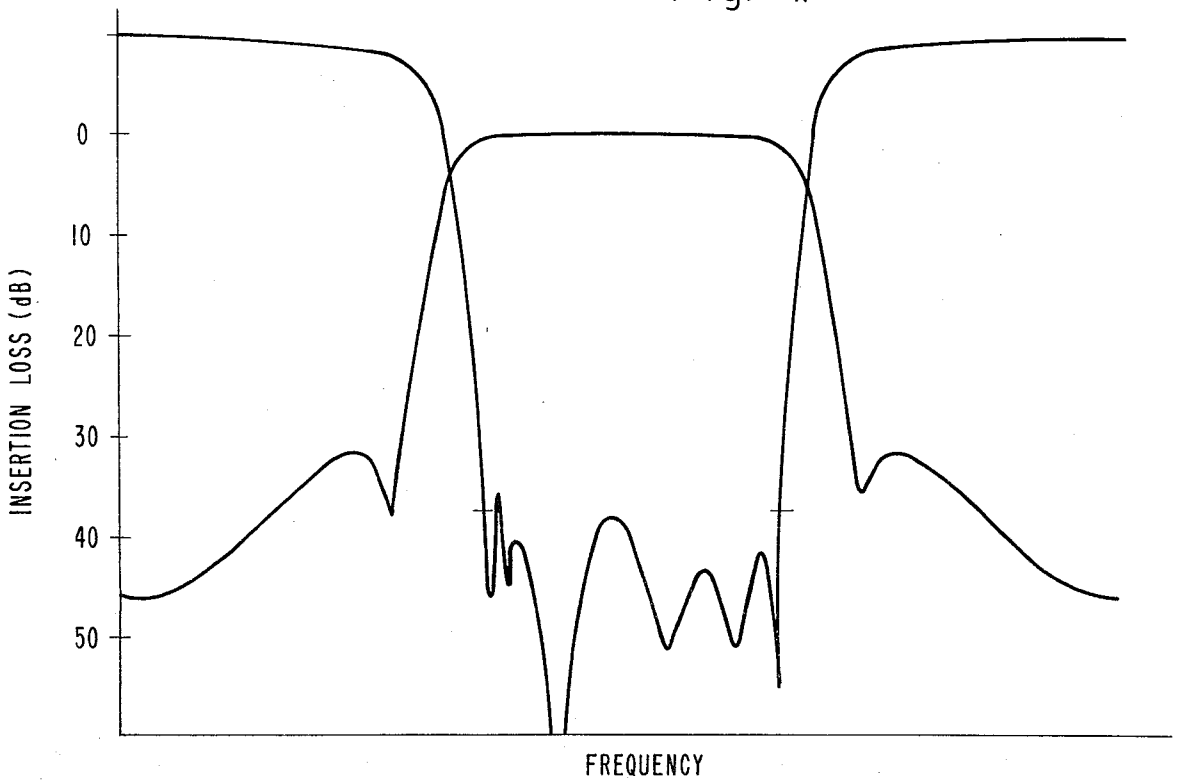
FIG. 7 is a graph showing the elliptic function response of the microwave filter of FIG. 2.

To obtain the desired responses, especially the elliptic function, coupling of non-adjacent modes is necessary. Irises 20, 26, 28, and coupling tuning screws 44 may be used to effectuate this type of coupling, generally referred to as bridge coupling. In the preferred embodiment, the only bridge couplings used are those effectuated by third coupling tuning screws 44 for coupling modes 1 and 3 and modes 4 and 6. If the third coupling screws 44 in both spherical cavities 17 and 19 are absent, so that modes 1–3 and 4–6 are not coupled, a Tchebychev function responses as shown in FIG. 6 is provided. If the third coupling screws 44 are present and positioned to couple modes 1–3 and 4–6, an elliptic function response as shown in FIG. 7 is provided. In other applications, irises 20, 26, 28 may be used to effectuate bridge couplings between a mode residing in a cavity with another which is outside it such as 0–2, 2–5, and 4–7. A list of the possible types of coupling and the coupling element used in each is shown in the following Table I.

TABLE I

| MAINLINE COUPLINGS OF MODES | ELEMENT |
|---|---|
| 0–1 | Iris 26 |
| 1–2 | Screw 44 |
| 2–3 | Screw 44 |
| 3–4 | Iris 20 |
| 4–5 | Screw 44 |
| 5–6 | Screw 44 |
| 6–7 | Iris 28 |
| **BRIDGE COUPLINGS OF MODES** | **ELEMENT** |
| 0–2 | Iris 26 |
| 0–3 | Iris 26 |
| 1–3 | Screw 44 |
| 1–5 | Iris 20 |
| 1–6 | Iris 20 |
| 2–5 | Iris 20 |
| 2–6 | Iris 20 |
| 3–5 | Iris 20 |
| 3–6 | Iris 20 |
| 4–6 | Screw 44 |
| 4–7 | Iris 28 |
| 5–7 | Iris 28 |

Microwave filter 12, constructed from spherical cavities which have the highest Q or the lowest losses of all cavity geometries, is capable of producing the bandpass Tchebychev and elliptic function responses shown in FIGS. 6 and 7, respectively. This Q is approximately 10,000 at 12 $GH_z$. Compared to a conventional cylindrical $TE_{111}$, six electrical section, dual mode filter, the Q of filter 12 is approximately 50% higher. Moreover, the volume of filter 12 is 30% smaller and its weight is at least 30% less than that of the dual mode filter.

It will be apparent to those skilled in the art that various modifications may be made within the spirit of the invention and the scope of the appended claims. For example, the rectangular irises 20, 26 and 28 may be replaced by any suitable shape such as a circle or a cross when modes other than $TM_{011}$ are used. In addition, a self-equalized Tchebychev function response may be obtained by merely altering the depths of third coupling screws 44 in cavities 17 and 19, and similarly a self-equalized elliptic function response may be obtained by merely altering the location of coupling holes 24 and screws 44 on cavities 17 and 19. Self-equalization is the process of reducing the frequency and/or phase distortion of a system in order to compensate for the difference in attentuation and/or time delay at the various frequencies in the desired transmission band. Moreover, filter 12 is readily modified to comprise a chain of more than two spherical cavities for appropriate applications.

What is claimed is:

1. A tri-mode spherical cavity microwave filter for use in a microwave system having electromagnetic energy propagating therethrough, said filter comprising:

two tandemly disposed generally spherical bodies each of which defines a spherical cavity which is adapted to support three identical, mutually orthogonal modes of said electromagnetic energy, said identical modes being three mutually orthogonal orientations of one mode;

one of said spherical cavities having an input aperture adapted to receive said electromagnetic energy, said input aperture being adapted to transfer said electromagnetic energy from a mode residing outside said one cavity into another mode residing within said one cavity;

another of said spherical cavities having an output aperture adapted to transmit said electromagnetic energy, said output aperture being adapted to transfer said electromagnetic energy from a mode residing within said another cavity into another mode residing outside said another cavity;

a cavity coupling aperture connecting said spherical cavities, said aperture being adapted to transfer said electromagnetic energy from a mode residing in said one cavity into another mode residing in said another cavity;

each of said spherical cavities having a plurality of cavity tuning holes and a like plurality of cavity tuners extending into said cavity through said cavity tuning holes, each cavity tuner serving to independently tune a respective one of said mutually orthogonal modes to the filter resonant frequency; and each of said spherical cavities also having a plurality of coupling tuning holes and a like plurality of coupling tuners extending into said cavity through said coupling tuning holes, each coupling tuner serving to transfer said electromagnetic energy from one mode to another mode both of which residing within the same spherical cavity.

2. The spherical cavity microwave filter as claimed in claim 1, wherein said identical, mutually orthogonal modes are $TM_{011}$ modes.

* * * * *